US007955114B2

(12) United States Patent
Wu

(10) Patent No.: US 7,955,114 B2
(45) Date of Patent: Jun. 7, 2011

(54) CABLE ASSEMBLY WITH LATCHING MECHANISM

(75) Inventor: Jerry Wu, Irvine, CA (US)

(73) Assignee: Hon Hai Precision Inc. Co., Ltd., New Taipei (TW)

( * ) Notice: Subject to any disclaimer, the term of this patent is extended or adjusted under 35 U.S.C. 154(b) by 0 days.

(21) Appl. No.: 12/939,188

(22) Filed: Nov. 4, 2010

(65) Prior Publication Data

US 2011/0104931 A1 May 5, 2011

(30) Foreign Application Priority Data

Nov. 4, 2009 (CN) ..... 200920314033

(51) Int. Cl.
*H01R 13/627* (2006.01)

(52) U.S. Cl. ..... 439/352

(58) Field of Classification Search ..... 439/352, 439/357, 358
See application file for complete search history.

(56) References Cited

U.S. PATENT DOCUMENTS 6,132,231 A * 10/2000 Suzuki ..... 439/352
7,175,465 B1 * 2/2007 Tsai ..... 439/352

FOREIGN PATENT DOCUMENTS

CN 200420022197 9/2005

* cited by examiner

*Primary Examiner* — Tho D Ta
(74) *Attorney, Agent, or Firm* — Wei Te Chung; Andrew C. Cheng; Ming Chieh Chang

(57) ABSTRACT

An cable assembly (1000) includes an insulative housing (7); a plurality of terminals (211, 222) received in the insulative housing; a cable (6) having a plurality of wires connected to the terminals; and a latching member (3*a*) assembled to the insulative housing, the latching member having a latching arm (32) and an inclined tab (324) upwardly and inwardly projecting from the latching arm; an actuating member (7) having a frame (70) and an elastic arm (71) protruding backwardly from a lateral side of the frame, and an actuating tab (72) protruding inwardly from the elastic arm; an external cover (51) with a deformable button (514) formed at a lateral side thereof. The deformable button is pressed to urge the elastic arm of the actuating member inwardly movement and the actuating tab moves inwardly to downwardly press the tab so as to lower the latching arm.

20 Claims, 7 Drawing Sheets

CABLE ASSEMBLY WITH LATCHING MECHANISM

FIELD OF THE INVENTION

The present invention generally relates to a cable assembly, and more particularly to a cable assembly with an improved latching mechanism.

DESCRIPTION OF PRIOR ART

Nowadays, an electrical device has become lower profile and multi-functional, and a cable assembly for the electrical device is also capable of high-speed transmitting, and reliably connection and easily detachable with its counterpart.

CN patent No. 200420022197 issued to Peng on Sep. 7, 2005 discloses a cable assembly. The cable assembly includes an insulative housing, a plurality of terminals accommodated in the insulative housing, a metallic shell enclosing the insulative housing, two locking members mounted to two sides of the insulative housing and two clamping members adapted for securing the two locking members, an external cover and a cable. Each locking member has a mounting portion fixed to the insulative housing, a deformable arm connected to the mounting portion and deflected along up-to-down direction, in addition, a hook is formed at a front end of the deformable arm, and an upward protrusion is formed on the deformable arm and accessible by a deformable button which is formed on a top side of the external cover. However, it is inconvenient for a user to operate the button of one or more the cable assembly when several cable assemblies are arranged in stacked manner or there is less space above the cable assembly when it is used for special application.

Hence, an improved cable assembly is highly desired to overcome the aforementioned problems.

SUMMARY OF THE INVENTION

Accordingly, an object of the present invention is to provide a cable assembly with improved latching mechanism.

In order to achieve the object set forth, a cable assembly in accordance with the present invention comprises an insulative housing; a plurality of terminals received in the insulative housing; a cable having a plurality of wires connected to the terminals; and a latching member assembled to the insulative housing, the latching member having a latching arm and an inclined tab upwardly and inwardly projecting from the latching arm; an actuating member having a frame and an elastic arm protruding backwardly from a lateral side of the frame, and an actuating tab protruding inwardly from the elastic arm; an external cover with a deformable button formed at a lateral side thereof, wherein the deformable button is pressed to urge the elastic arm of the actuating member inwardly movement and the actuating tab moves inwardly to downwardly press the tab so as to lower the latching arm.

Other objects, advantages and novel features of the invention will become more apparent from the following detailed description when taken in conjunction with the accompanying drawings.

DETAILED DESCRIPTION OF PREFERRED EMBODIMENTS

Figure 1:
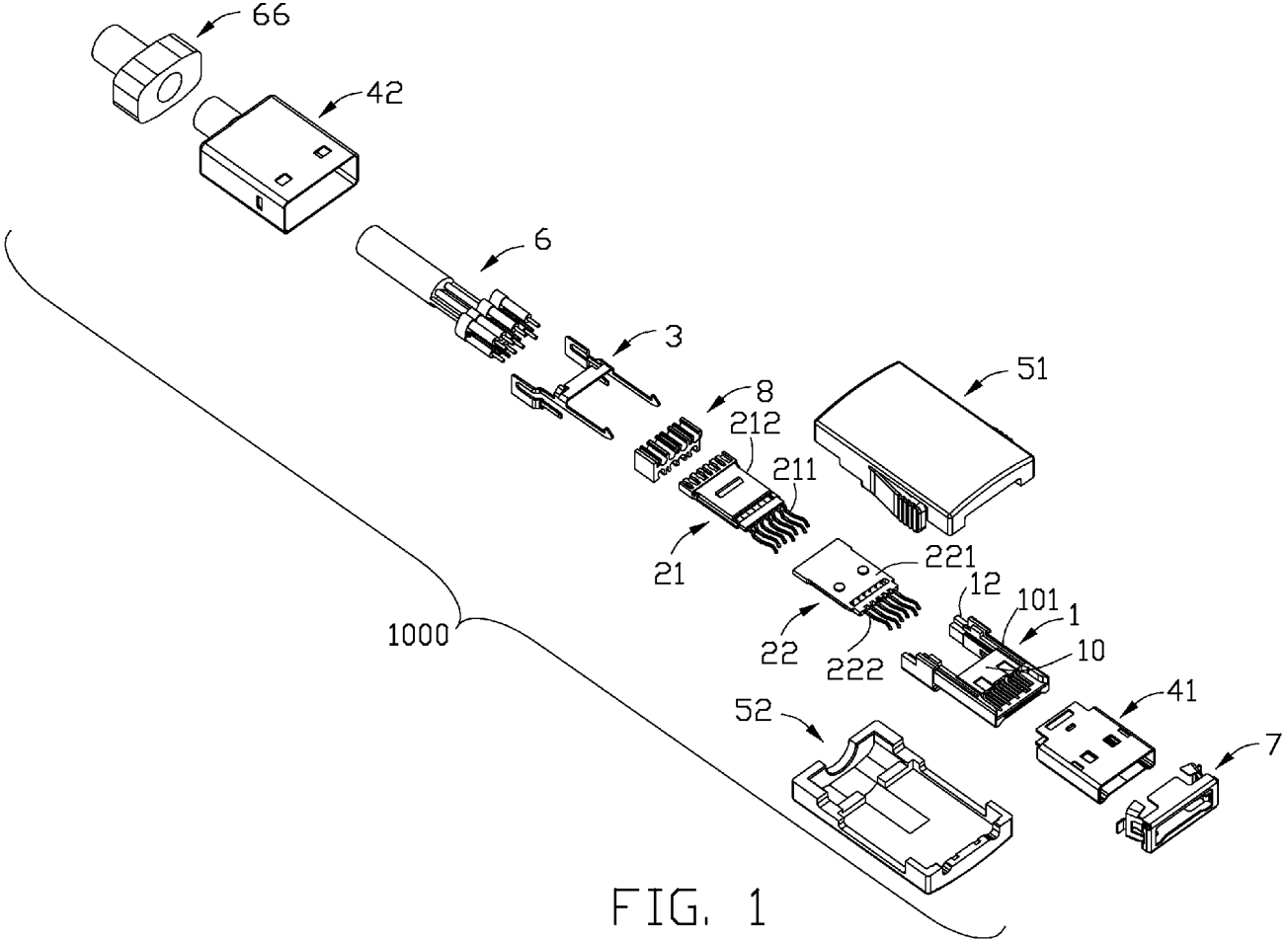
FIG. 1 is an exploded, perspective view of a cable assembly in accordance with the present invention.

Reference will now be made in detail to the preferred embodiment of the present invention.

Referring to FIGS. 1-7, a cable assembly 1000 in accordance with the present invention comprises an insulative housing 1, a terminal module 2 assembled to the insulative housing 1, a latching device 3 mounted to the insulative housing 1, a metallic shell shrouding the insulative housing, an external cover 5 enclosing the metallic shell, a cable 6 connected to the terminal module 2, an actuating member 7 shielded by the metallic shell and an insulative spacer 8.

The insulative housing 1 includes a main portion 10 and two mounting arms 12 extending rearwardly from lateral sides of the main portion 10. A receiving space 102 is recessed forwardly from a middle segment of a rear edge of the main portion 10. A cavity 104 is recessed downwardly from a front segment of a top side of the main portion 10 and further communicates with the receiving space 102. A depression 104' is defined in a lower side of the main portion 10, and the depression 104' is of isosceles trapezoid shape. A slot 101 is defined in the mounting arm 12 and partial of main portion 10 in front of the mounting arm 12. A positioning hole 126 is defined in a rear portion 124 of the mounting arm 12.

The terminal module 2 includes a first terminal module 21 and a second terminal module 22. The first terminal module 21 has an insulator 211 and a number of terminals 212 combined together by insert-molding process. The terminals 212 are divided into signal terminals and grounding terminals configured to be longer than the signal terminals. The terminals 212 have contacting portions 2120 disposed in front of an edge of the insulator 211 and tail portions (not numbered) which are accommodated in terminal slots 2112 defined in a back segment of the insulator 211. Two mounting holes 2110 are defined in a bottom side of the insulator 211 and a protruding portion 2111 are formed on a top side of the insulator 211.

The second terminal module 22 has an insulator 221 and a number of terminals 222 combined together by insert-molding process. The terminals 222 are divided into signal terminals and grounding terminals configured to be longer than the signal terminals. The terminals 222 have contacting portions 2220 disposed in front of an edge of the insulator 221 and tail portions (not numbered) which are accommodated in terminal slots 2212 defined in a back segment of the insulator 221. Two mounting posts 2210 are formed on a top side of the insulator 221. There are two protruding portions (not numbered) formed on a bottom side of the insulator 221.

The first terminal module 21 and the second terminal module 22 are assembled together, with the contacting portions 2120, 2220 merged into one row, while the tail portions separated into two distinct rows along an up-to-down direction. The mounting posts 2210 are inserted into the mounting holes 2110 so as to keep the first terminal module 21 and the second terminal module 22 together. The first terminal module 21 and the second terminal module 22 are assembled to the insulative housing 1, with front segments of the insulators 211, 221 inserted into the receiving space 102.

The latching device 3 includes two latching members 3*a* separated from each other along a transversal direction and a transversal arm 3*b* connected to the two latching members 3*a* together. Each latching member 3*a* includes a connecting arm 30, a latching arm 32 and a retention arm 33. The latching arm 32 and the retention arm 33 are spaced apart from each other and extend forwardly from the connecting arm 30. The latching arm 32 and the retention arm 33 are located in a vertical plane. The connecting arm 30 has a U-shaped body portion 31 and a first bridge portion 311 and a second bridge portion 312 formed with front ends of the body portion 31. The first bridge portion 311 and the second bridge portion 312 are inwardly deflected and extend forwardly to engage with the latching arm 32 and the retention arm 33, respectively. Therefore the U-shaped body portion 31 is disposed in other vertical plane and parallel to the latching arm 32 and the retention arm 33. An inclined tab 324 is disposed behind the transversal arm 3*b* and upwardly and inwardly projects from the latching arm 32. The retention arm 33 is inserted into the positioning hole 126 of the mounting arm 12, and the latching arm 32 is received in the slot 101 of the insulative housing 1. The connecting arm 30 is located behind the mounting arm 12 and adjacent to an outer surface of the mounting arm 12, therefore, more space is left inside the connecting arm 30.

The metallic shell 4 has a first shell 41, a second shell 42 are assembled together along a front-to-back direction. The actuating member 7 is disposed between the first shell 41 and the second shell 42.

The first shell 41 is a sleeve member to accommodate the main portion 10 therein. Two through holes 4110 are defined in a front segment of a top side 411*a* of the first shell 41 to allow hooks 322 of the latching arms 32 passing through. A first engaging portion 4110*a* projects backward from the top side 411*a*. There is a positioning hole 4112 defined in the first engaging portion 4110*a* to latch with the protruding portion 2111 of the first terminal module 21. The first shell 41 further has an inwardly recessed bottom side 411*b* suitably matching with the depression 104' of the insulative housing 1. A second engaging portion 4110*b* projects backward from the bottom side 411*b*. There are two positioning holes 4114 defined in the second engaging portion 4110*b* to latch with the protruding portions of the second terminal module 22.

The second shell 42 includes a rectangular shaped main portion which has an upper side 4201, a lower side 4202, a back side 4203 and two lateral sides (not numbered) joined together. The second shell 42 further includes a boot 423 extending backwardly from the back side 4203. Two holes 4205 are defined in lateral sides of the upper side 4201. A through hole 4206 is defined in a front part of each lateral side.

The external cover 5 includes an upper cover 51 and a bottom cover 52. The upper cover 51 has a first hollow 511 and a second hollow 512 disposed behind the first hollow 511. A rectangular shaped opening 5110 is located in the front portion of the upper cover 51, and the opening 5110 further communicates with the first hollow 511. A semicircular shaped outlet 513 is defined in the rear portion of the upper cover 51 and communicated with the second hollow 512. Two deformable buttons 514 are formed at lateral sides of the upper cover 51 and capable of floatable along transversal direction to enter the first hollow 511.

The bottom cover 52 is similar to the upper cover 51, and also has a first hollow 521 and a second hollow 522 disposed behind the first hollow 521. An opening 5210 is located in the front portion of the bottom cover 52, and the opening 5210 further communicates with the first hollow 521. A semicircular shaped outlet 523 is defined in the rear portion of the bottom cover 52 and communicated with the second hollow 522.

The cable 6 includes a number of wire groups enclosed in a jacket 60. Each wire group includes a pair of signal wires 61 and a grounding wire 62 disposed aside the pair of wires 61, and a shielding member 63 shrouding the pair of wires 61. Each signal wire 61 has an inner conductor 610. The shielding member 63 is aluminum foil or other similar structure. A strain relief member 66 is molded over a front segment of the cable 6 and accommodated in the second hollows 512, 522.

The actuating member 7 is made of metallic sheet, and includes frame 70, two L-shaped elastic arms 71 protrude backwardly from lateral sides of the frame 70. There is an actuating tab 72 formed at back part of a top edge of the elastic arm 71 and protrudes inwardly and downwardly. An engaging portion 73 inwardly projects from a back part of a lower edge of the elastic arm 71. The actuating tab 72 and the engaging portion 73 disposed face-to-face manner along a vertical direction. A wing 74 protrudes outwardly from an end of the elastic arm 71. A hole 710 is defined in a middle segment of the elastic arm 71 so as to adjust flexibility thereof. The frame 70 further has an outlet 701 therein, and the outlet 701 matches with a peripheral of the first shell 41. The elastic arm 71 disposed outward of the rear portion 124 of the corresponding mounting arm 12. The actuating tab 72 located above the rear portion 124 of the mounting arm 12, disposed outward and proximate to the inclined tab 324 of the latching arm 32. The engaging portion 73 abuts at a bottom side of the rear portion 124.

The insulative spacer 8 includes a main portion 80 which has a number of positioning cavities 81 respectively defined in a top and a bottom segments thereof. The positioning cavities 81 are arranged between first protrusions 82 and second protrusions 82'. The first protrusions 82 and the second protrusions 82' are disposed in alternated manner along a transversal direction. In addition, the first protrusions 82 are broader than the second protrusions 82'. Each of the first protrusions 82 defines a groove 820 therein. The groove 820 is narrower than the positioning cavity 81.

The insulative spacer 8 is mounted to a back side of the first terminal module 21 and the second terminal module 22. The pair of signal wires 61 of the each wire group are held in the two positioning cavities 81 at the top and the bottom sides of the main portion 80, and conductors 610 inside the signal wires 61 extend into the terminal slots 2112, 2222 and are placed on the tail portions of the terminals 212, 222 so as to achieve electrical connection therebetween. The grounding wire 62 is positioned in a corresponding groove 820 and further extends into a corresponding terminal slot 2112/2222. The conductors 610 are soldered to tail portions of the signal terminals, and the grounding wires 62 are soldered to tail portions of the grounding terminals. The insulative spacer 8 is used for organizing the wires of the cable 6 so as to facilitate soldering process.

The first shell 41 encloses the main portion 10 of the insulative housing 1, the actuating member 7 is mounted to a back side of the first shell 41. The second shell 42 shrouds the frame 70 of the actuating member 7. The inclined tab 324 of the latching arm 32 projects into the hole 4205 defined into a front segment of the upper side 4201. The wing 74 protrudes outward via the through hole 4206. The cable 6 backwardly protrudes outside via the boot 423.

Figure 2:
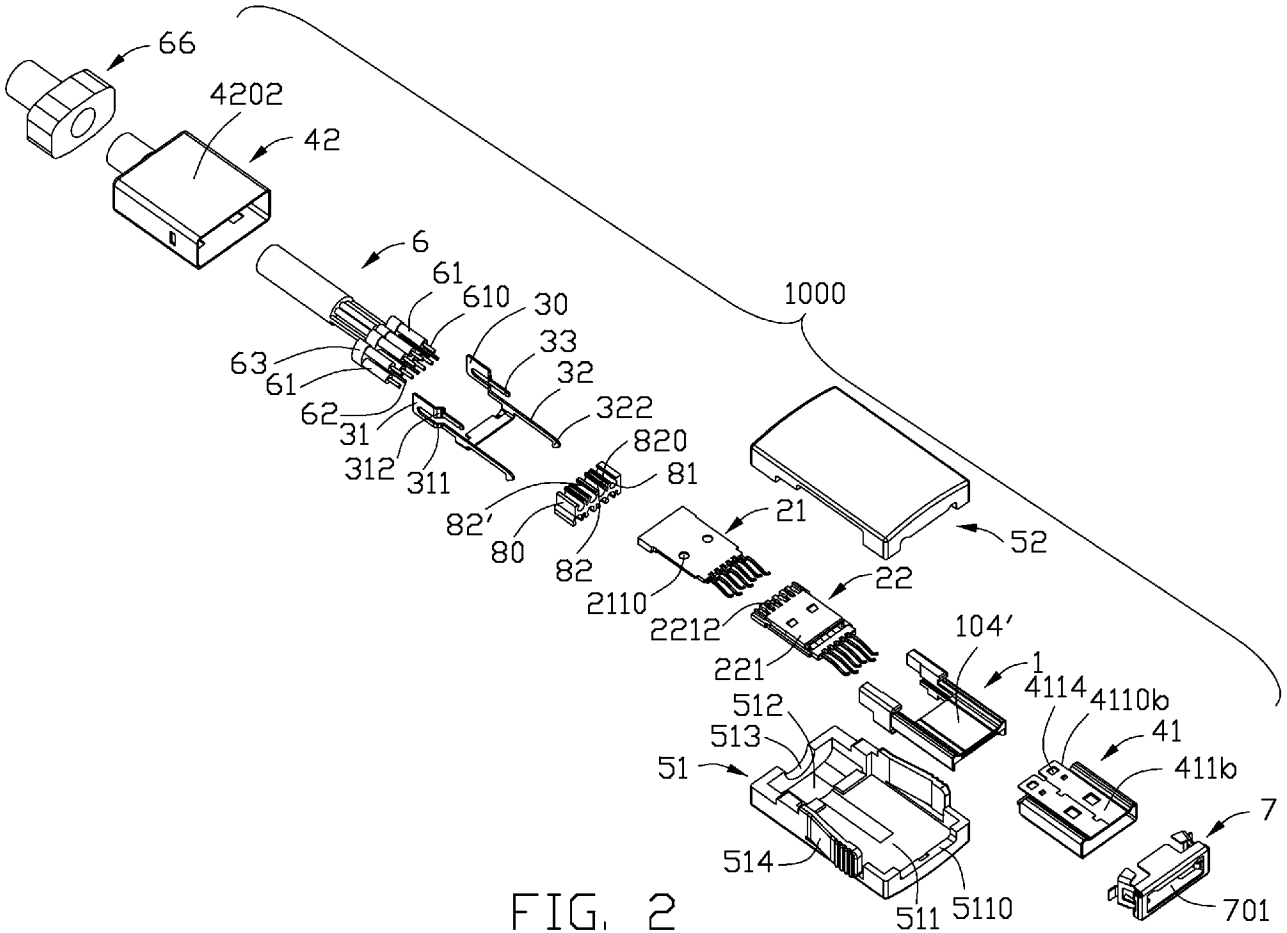
FIG. 2 is similar to FIG. 1, but viewed from other aspect.
Figure 3:
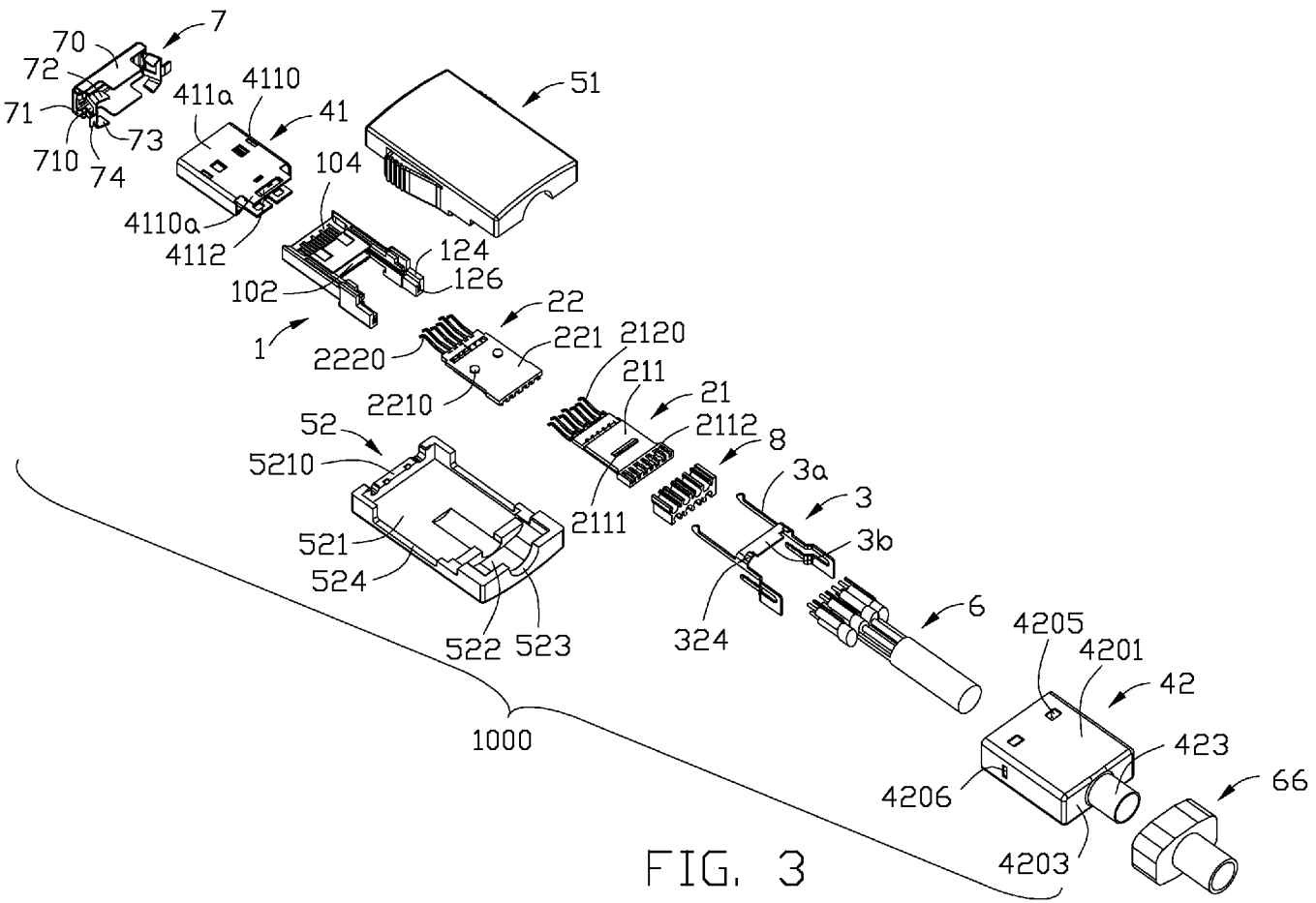
FIG. 3 is similar to FIG. 1, but viewed from another aspect.
Figure 4:
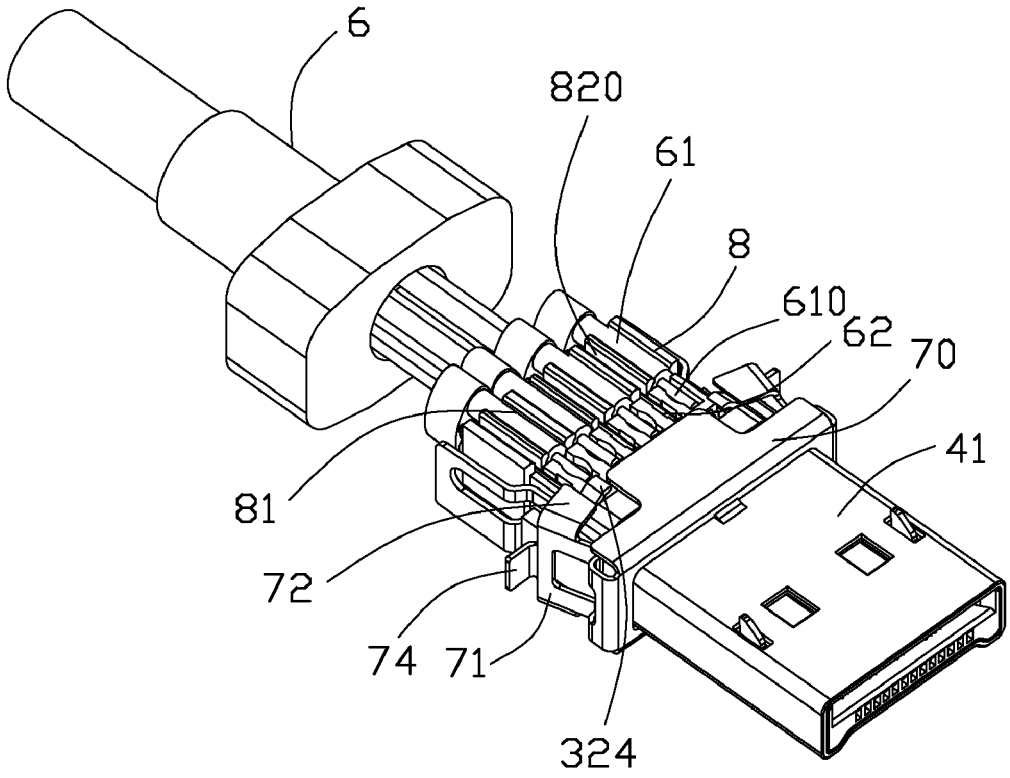
FIG. 4 is a partially assembled view of the cable assembly.
Figure 5:
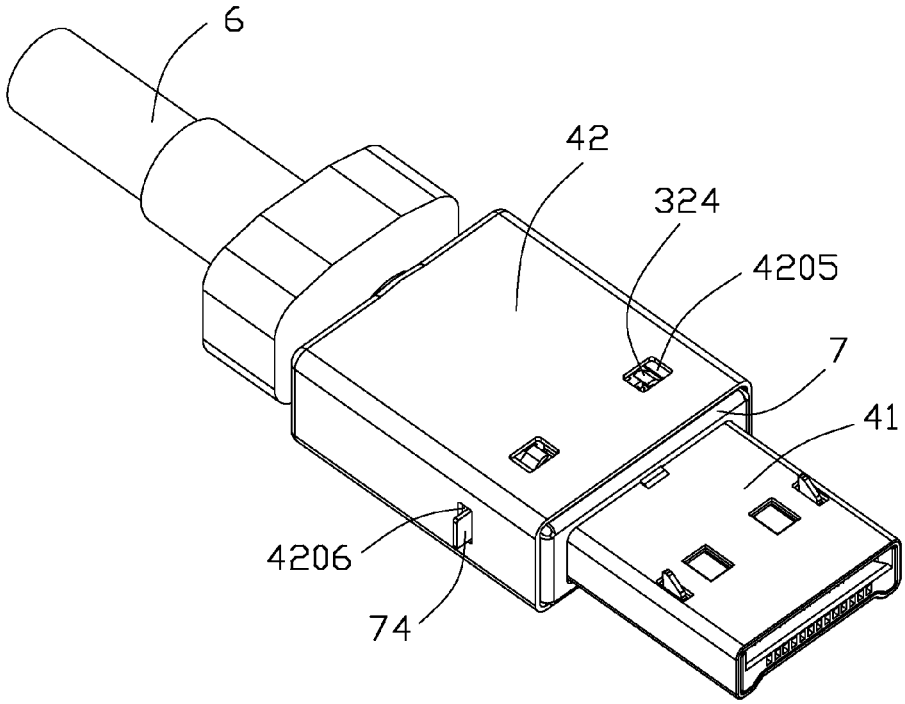
FIG. 5 is other partially assembled view of the cable assembly.
Figure 6:
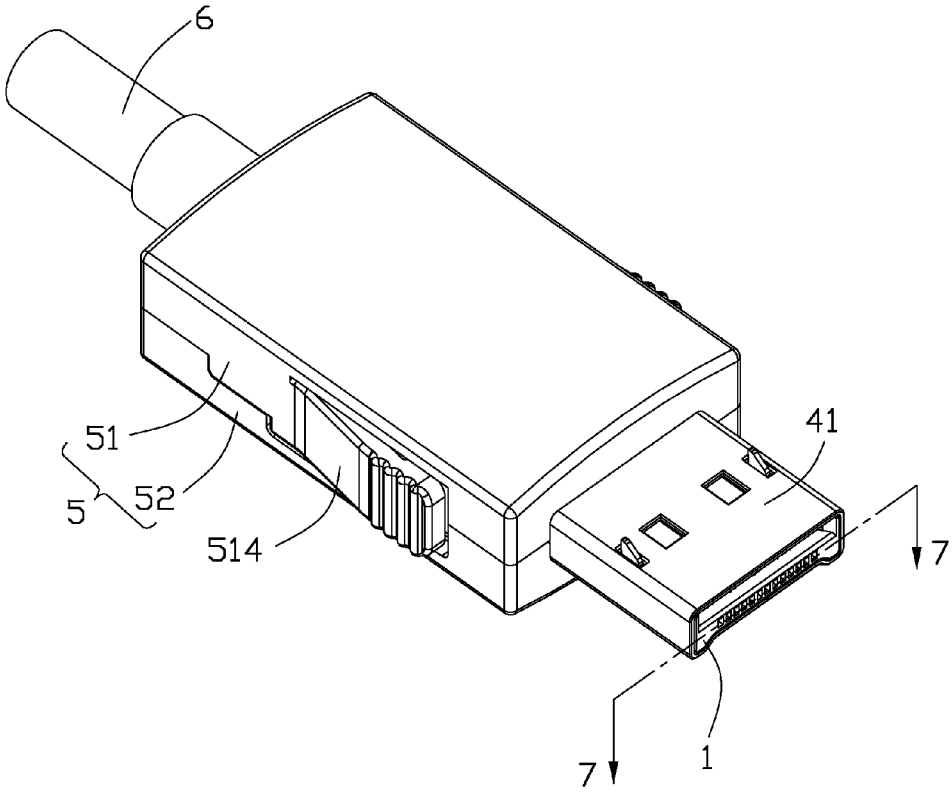
FIG. 6 is an assembled, perspective view of the cable assembly.
Figure 7:
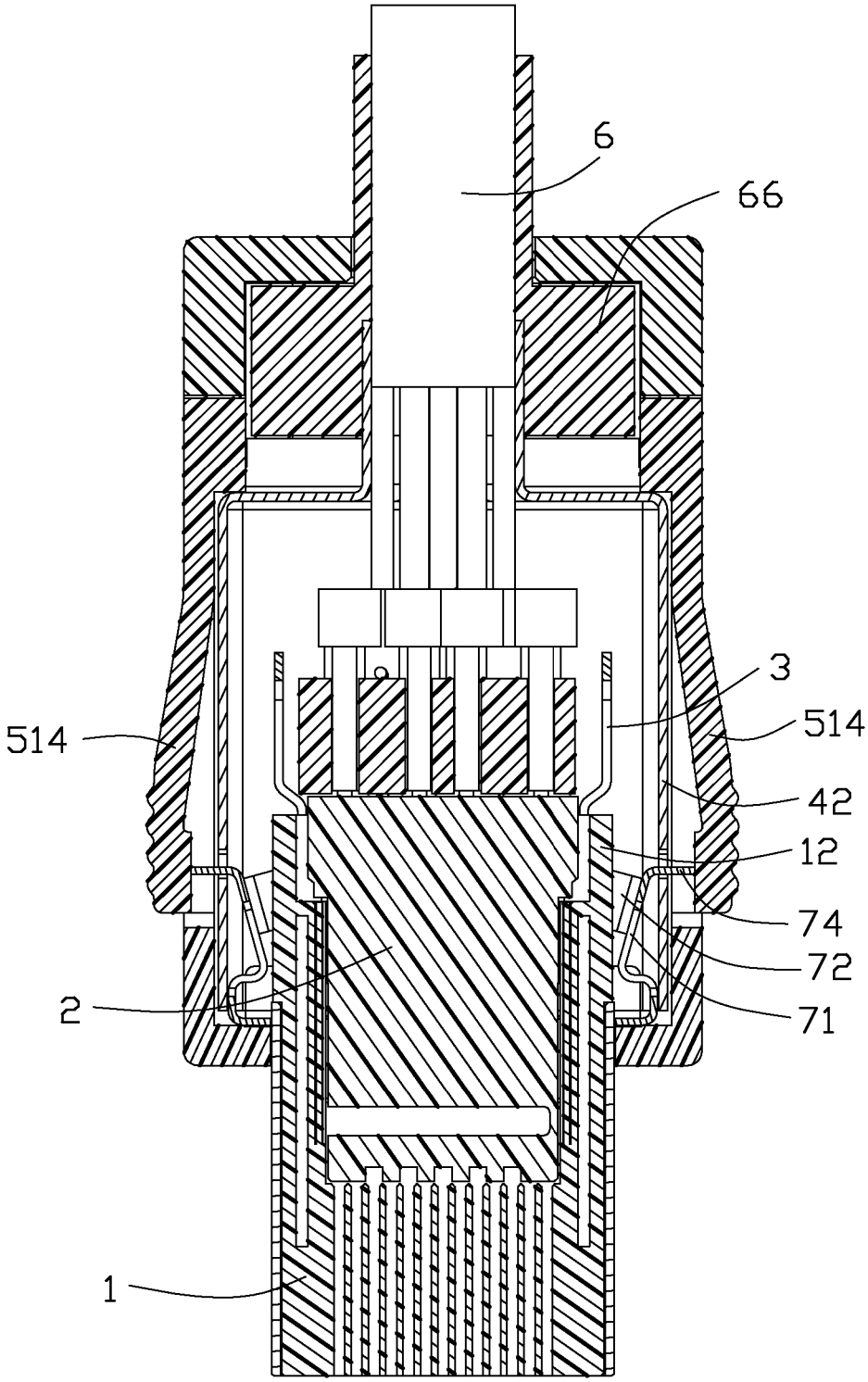
FIG. 7 is a cross-section view taken along line 7-7 of FIG. 6.

The cable assembly 1000 is in accordance with DiiVA (Digital Interactive Interface for Video & Audio) standard. Referring to FIGS. 1-2, within the cavity 104, along a left-to-right direction, there are thirteen terminals 212, 222 which are arranged in such manner: G-S-S-G-S-S-G-S-S-G-G-S-S. G represents grounding terminal, and S represent signal terminal. There are three differential pairs consisted of six signal terminals located between grounding terminals. The differential pairs for high-speed transmitting used for conveying video signals. And a pair of signal terminals disposed in the right side cavity 104 used for audio signals.

When detach the cable assembly 100 from a complementary connector, just press the deformable button 514 to actuate the wing 74 which is just located inside and adjacent the deformable button 514, thus the elastic arm 71 moves inwardly and the actuating tab 72 moves inwardly to downwardly press the inclined tab 324, thus the latching arm 32 is lowered and retracts into the first shell 41, so as to separate from the complementary connector. The deformable button 514 and the actuating member 7 restore to their original position while no pressing force exerted on the deformable button 514.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

an insulative housing;

a plurality of terminals received in the insulative housing;

a cable having a plurality of wires connected to the terminals; and a latching member assembled to the insulative housing, the latching member having a latching arm and an inclined tab upwardly and inwardly projecting from the latching arm;

an actuating member having a frame and an elastic arm protruding backwardly from a lateral side of the frame, and an actuating tab protruding inwardly from the elastic arm;

an external cover with a deformable button formed at a lateral side thereof, wherein the deformable button is pressible to urge the elastic arm of the actuating member to move inwardly and the actuating tab is moveable inwardly to downwardly press the inclined tab so as to lower the latching arm.

2. The cable assembly as recited in claim 1, wherein there is a wing formed at an end of the elastic arm and protruding outwardly therefrom, and the wing is located adjacent to the deformable button.

3. The cable assembly as recited in claim 2, where there is a metallic shell shielding the insulative housing and the actuating member.

4. The cable assembly as recited in claim 3, wherein the inclined tab of the latching member projects into a hole which is defined in an upper side of the metallic shell.

5. The cable assembly as recited in claim 3, wherein the wing protrudes outward via a through hole defined in a lateral side of the metallic shell.

6. The cable assembly as recited in claim 3, wherein the metallic shell includes a first shell and a second shell assembled together along a front-to-back direction.

7. The cable assembly as recited in claim 6, wherein the actuating member is disposed between the first shell and the second shell.

8. The cable assembly as recited in claim 1, wherein the elastic arm of the actuating member is L-shaped.

9. A cable assembly, comprising:

an insulative housing;

a plurality of terminals received in the insulative housing;

a cable having a plurality of wires connected to the terminals;

a latching device assembled to the insulative housing, and the latching device including two latching members separated from each other along a transversal direction, each latching member having a latching arm and an inclined tab upwardly and inwardly projecting from the latching arm;

an actuating member having a frame and two elastic arms protruding backwardly from lateral sides of the frame, and an actuating tab protruding inwardly from each elastic arm and a wing projecting outwardly from the elastic arm, and the actuating tab disposed outside of and proximate to the corresponding inclined tab of the latching member;

an external cover with two deformable buttons formed at lateral sides thereof, and each deformable button located at outside of and adjacent to the wing of the actuating member.

10. The cable assembly as recited in claim 9, wherein there is a transversal arm connected to the two latching members.

11. The cable assembly as recited in claim 9, further comprising a metallic shell shielding the actuating member.

12. The cable assembly as recited in claim 11, wherein the metallic shell includes a first shell and a second shell assembled together along a front-to-back direction.

13. The cable assembly as recited in claim 12, wherein the frame of the actuating member is sandwiched between the first shell and the second shell.

14. The cable assembly as recited in claim 9, wherein the latching member has a retention arm connected to the latching arm, and the retention arm is inserted into the insulative housing.

15. The cable assembly as recited in claim 14, wherein the insulative housing includes a main portion and two mounting arms extending rearwardly from lateral sides of the main portion, and there is a positioning hole defined in the mounting arm to receive the retention arm of the latching member.

16. A cable assembly for use with a complementary connector, comprising:

an insulative housing;

a metallic shell enclosing said housing to commonly define a mating port with a mating face thereon;

a latching member assembled to at least one of the housing and the shell, and including a pair of latching arms extending along a front-to-back direction and deflectable in a vertical direction perpendicular to said front-to-back direction, each of said latching arms including a hook extending out of the shell for locking the complementary connector;

a plurality of contacts disposed in the housing with contacting sections extending into the mating port and exposed upon the mating face;

a plurality of wires located behind the housing and connected to the corresponding contacts;

an external cover enclosing the shell and the housing except the mating port, said cover including a pair of moveable buttons accessible from the exterior;

an actuating member positioned between the shell and the cover; and an oblique structure formed on at least one of said button and actuating member;

wherein pressing the buttons in a transverse direction perpendicular to both said front-to-back direction and said vertical direction results in inward movement of the actuating in said transverse direction and downward movement of the corresponding latching arm in the vertical direction via said oblique structure for retracting the corresponding hook in the vertical direction for release of the complementary connector.

17. The electrical connector as claimed in claim 16, wherein said hook is located upon a face of the shell parallel to the mating face.

18. The electrical connector as claimed in claim 16, wherein said actuating member is discrete from all said cover, said shell and said housing.

19. The electrical connector as claimed in claim 16, wherein said actuating member is of a frame structure attached upon the shell.

20. The electrical connector as claimed in claim 16, wherein said oblique structure includes a first part unitarily formed on the actuating member and a second part unitarily formed on the corresponding latching arm.

* * * * *